US006676366B2

(12) United States Patent
Kao

(10) Patent No.: US 6,676,366 B2
(45) Date of Patent: Jan. 13, 2004

(54) SUBMERSIBLE PUMP IMPELLER DESIGN FOR LIFTING GASEOUS FLUID

(75) Inventor: Alan Lin Kao, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 5 days.

(21) Appl. No.: 10/091,238

(22) Filed: Mar. 5, 2002

(65) Prior Publication Data

US 2003/0170112 A1 Sep. 11, 2003

(51) Int. Cl.[7] ..... F04D 29/24
(52) U.S. Cl. ..... 415/1; 415/58.2; 416/181
(58) Field of Search ..... 415/58.2, 1, 106, 415/199.2, 183, 181; 416/183, 181

(56) References Cited

U.S. PATENT DOCUMENTS

| | | | |
|---|---|---|---|
| 2,576,700 | A | 11/1951 | Schneider |
| 4,778,341 | A | 10/1988 | Corradini et al. |
| 5,224,821 | A | 7/1993 | Ozawa |
| 5,628,616 | A | 5/1997 | Lee |
| 5,885,058 | A | 3/1999 | Vilagines et al. |
| 6,241,470 | B1 | 6/2001 | Oakley et al. |

FOREIGN PATENT DOCUMENTS

| | | | |
|---|---|---|---|
| FR | 1.025.250 | A | 4/1953 |
| SU | 653.428 | A | 3/1979 |

*Primary Examiner*—Edward K. Look
*Assistant Examiner*—Kimya N McCoy
(74) *Attorney, Agent, or Firm*—Bracewell & Patterson, L.L.P.

(57) ABSTRACT

A gas-handling centrifugal pump has impellers for pumping gaseous materials containing up to 50% by volume free gas. The impellers have split vanes with high exit angles up to about 90 degrees and preferably greater than 50 degrees. The split vanes define flow passages that contain large diameter balance holes that typically range between 45% to 100% of the width between each split vane. The gas-handling centrifugal pump can be used as a charge pump for a centrifugal pump in a lower tandem configuration within a well.

21 Claims, 2 Drawing Sheets

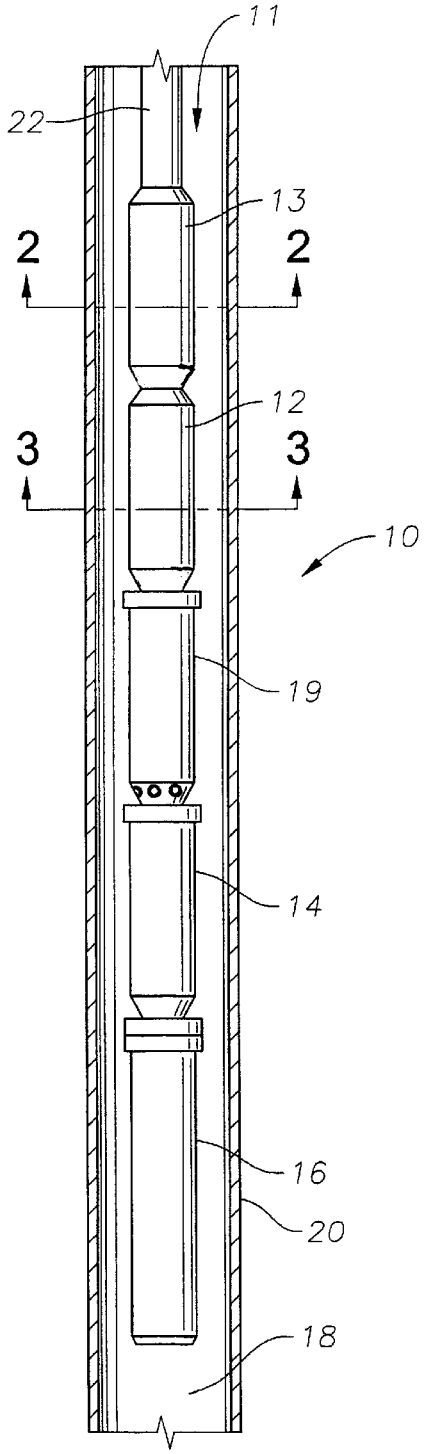
Fig. 1
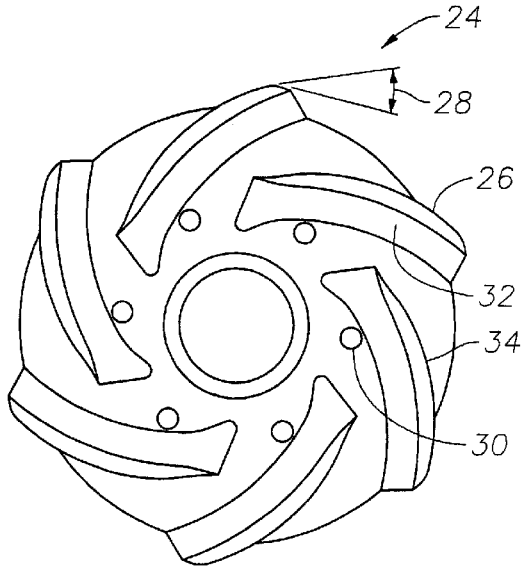
Fig. 2
(Prior Art)
Fig. 3
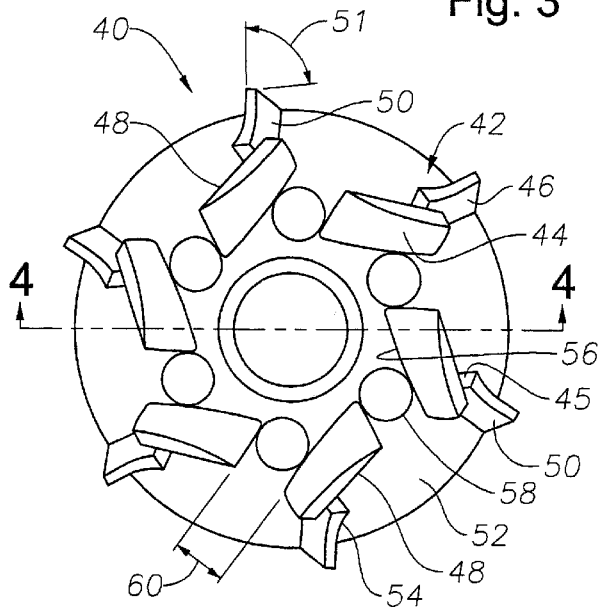

SUBMERSIBLE PUMP IMPELLER DESIGN FOR LIFTING GASEOUS FLUID

BACKGROUND OF THE INVENTION

1. Field of the Invention

This invention relates in general to electric submersible pumps. More specifically, this invention relates to submersible pumps that have an impeller configuration designed for fluids with a high gas content entrained within the fluids.

2. Description of the Prior Art

Centrifugal pumps have been used for pumping well fluids for many years. Centrifugal pumps are designed to handle fluids that are essentially all liquid. Free gas frequently gets entrained within well fluids that are required to be pumped. The free gas within the well fluids can cause trouble in centrifugal pumps. As long as the gas remains entrained within the fluid solution, then the pump behaves normally as if pumping a fluid that has a low density. However, the gas frequently separates from the liquids.

The performance of a centrifugal pump is considerably affected by the gas due to the separation of the liquid and gas phases within the fluid stream. Such problems include a reduction in the pump head, capacity, and efficiency of the pump as a result of the increased gas content within the well fluid. The pump starts producing lower than normal head as the gas-to-liquid ratio increases beyond a certain critical value, which is typically about 10–15% by volume. When the gas content gets too high, the gas blocks all fluid flow within the pump, which causes the pump to become "gas locked." Separation of the liquid and gas in the pump stage causes slipping between the liquid and gas phases, which causes the pump to experience lower than normal head. Submersible pumps are generally selected by assuming that there is no slippage between the two phases or by correcting stage performance based upon actual field test data and past experience.

Many of the problems associated with two phase flow in centrifugal pumps would be eliminated if the wells could be produced with a submergence pressure above the bubble point pressure to keep any entrained gas in the solution at the pump. However, this is typically not possible. To help alleviate the problem, gases are usually separated from the other fluids prior to the pump intake to achieve maximum system efficiency, typically by installing a gas separator upstream of the pump. Problems still exist with using a separator upstream of a pump since it is necessary to determine the effect of the gas on the fluid volume in order to select the proper pump and separator. Many times, gas separators are not capable of removing enough gas to overcome the inherent limitations in centrifugal pumps.

A typical centrifugal pump impeller designed for gas containing liquids consists of a set of one-piece rotating vanes, situated between two disk type shrouds with a balance hole that extends into each of the flow passage channels formed by the shrouds and two vanes adjacent to each other. In liquid lifting practice, an average value of 25 degrees is considered normal for all vane discharge angles. The size of the balance holes have traditionally been approximately 1/8" (0.125") through 3/16" (0.1875") in diameter for most pump designs. Deviations from the typical pump configurations have been attempted in an effort to minimize the detrimental effects of gaseous fluids on centrifugal pumps. However, even using these design changes in the impellers of the centrifugal pumps is not enough, there are still problems with pump efficiency, capacity, and head.

One such attempt to modify a conventional centrifugal pump impeller for pumping fluids containing a high percentage of free gas can be found in U.S. Pat. No. 5,628,616 issued to Lee. The Lee Patent teaches the use of balance and recirculation holes for pressure equalization and recirculation of the fluid around the impeller. However, the impeller in Lee can only handle fluids containing up to 35% vol. of free gas. Above this level of gas content, the Lee pump would still become gas locked.

A need exists for an ESP and method of pumping high gas containing fluids without causing a pump to become gas-locked and unable to pump the fluid. Ideally, such a system should be capable of being adapted to the specific applications and also be able to be used on existing equipment with minimal modification.

SUMMARY OF THE INVENTION

Centrifugal pumps impart energy to a fluid being pumped by accelerating the fluid through an impeller. This invention provides a novel method and apparatus for pumping well fluids with a high gaseous content by utilizing a centrifugal pump with an improved impeller design that is optimized for use in gaseous liquids. The improved impeller has a new vane design, which can be combined with high discharge angles and large balance holes.

This invention introduces an unconventional split-vane impeller design with increased vane exit angle and oversized balance holes. The improvements provide homogenization to the two-phase flow due to the split-vane design. Pump performance is optimized by increased vane exit angle, which is typically in the range of about 50 degrees to about 90 degrees. The oversized balance holes provide additional gas and liquid mixing.

The split-vane impeller comprises two portions, an inner radial member and an outer radial member, with each portion having a different radius of curvature. An inner edge of the inner radial member is offset from an outer edge of the outer radial member, without the inner edge of the inner radial member contacting the outer radial member. The inner edge of the inner radial member can lead or trail the outer edge of the outer radial member. The space between the inner and outer radial members allows for improved mixing of the well fluid to assist in homogenizing the gas in the liquid phase.

The impeller has a plurality of flow passages that are defined by a split-vane on one side and a next split-vane on the opposite side. Each flow passage comprises one balance hole. The balance hole has a diameter in a range of about 45% to about 100% of a distance that is measured from the inner edge of the inner radial member to the outer edge of the next inner radial member. This range for the balance hole diameter corresponds to a diameter of at least 7/32" (0.2188") and greater. The balance hole can be substantially tangential to the split-vanes.

A centrifugal pump containing the impeller with the split-vanes, high exit angles, and balance holes can be used as a charge pump for a traditional centrifugal pump. As an alternative, the impeller designed in accordance with the present invention can be used in one or more stages within a centrifugal pump that also has one or more conventionally designed impellers. The centrifugal pump of the present invention can be used as part of a well assembly. A gas separator can be installed upstream of the charge pump to reduce the amount of free gas in the system prior to pumping. Other variations of the present invention will be known to those skilled in the art and are to be considered within the scope of the present invention.

BRIEF DESCRIPTION OF THE DRAWINGS

So that the manner in which the features, advantages and objects of the invention, as well as others which will become apparent, may be understood in more detail, more particular description of the invention briefly summarized above may be had by reference to the embodiment thereof which is illustrated in the appended drawings, which form a part of this specification. It is to be noted, however, that the drawings illustrate only a preferred embodiment of the invention and is therefore not to be considered limiting of the invention's scope as it may admit to other equally effective embodiments.

FIG. 1 is a side elevational view of a centrifugal pump disposed in a viscous fluid within a well, constructed in accordance with this invention.

FIG. 2 is a sectional view of a conventional design of an impeller taken along the line 2—2 of FIG. 1.

FIG. 3 is a cross-sectional view of an impeller of the centrifugal pump of FIG. 1, taken along the line 3—3 of FIG. 1.

DETAILED DESCRIPTION OF THE INVENTION

Figure 4:
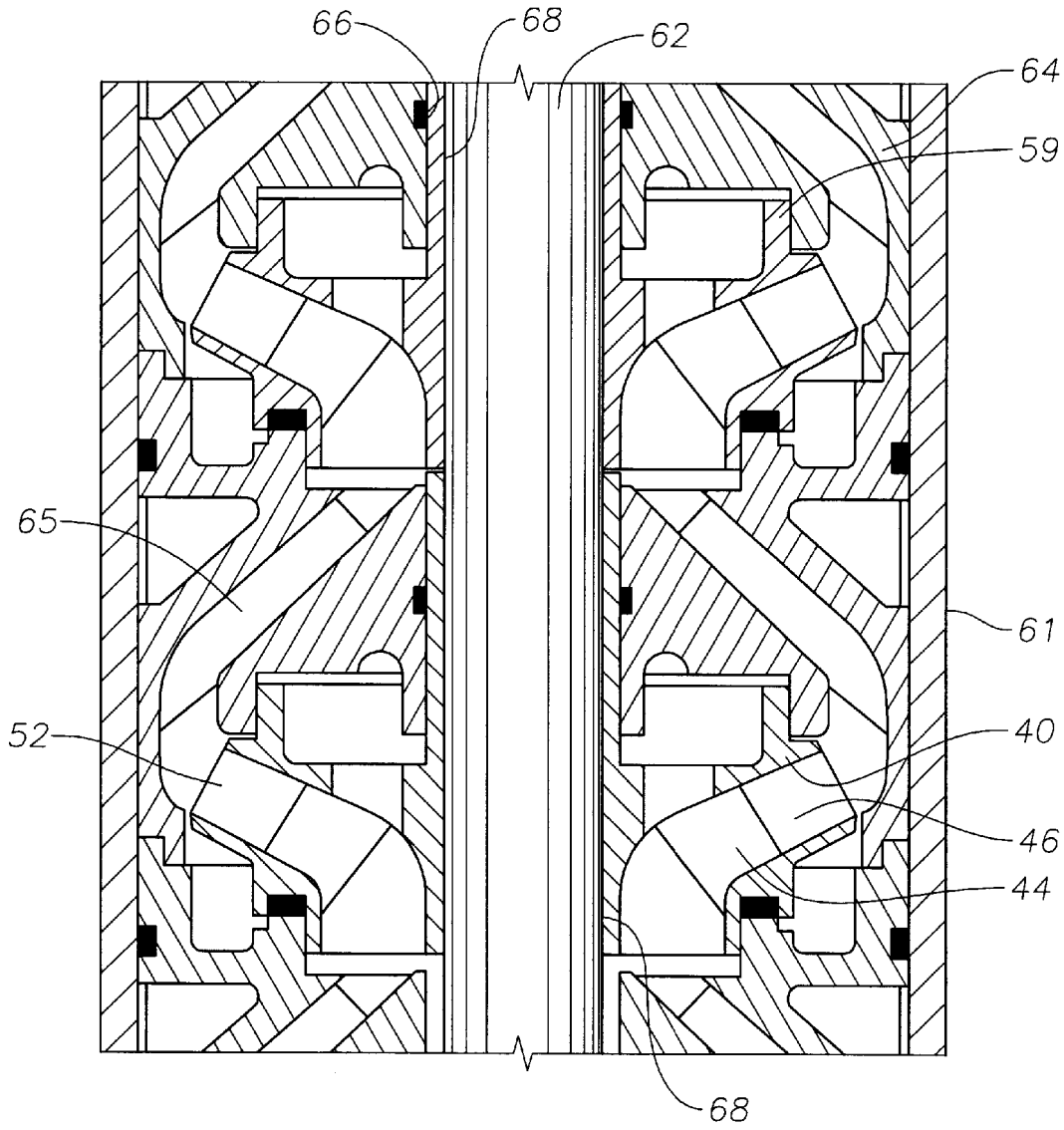
FIG. 4 is a sectional view of a diffuser and an impeller taken along the line 4—4 of FIG. 3.

Referring to the drawings, FIG. 1 generally depicts a well 10 with a submersible pump assembly 11 installed within. The pump assembly 11 comprises a charge pump 12 connected to a centrifugal pump 13 that has a seal section 14 attached to it and an electric motor 16 submerged in a well fluid 18. Centrifugal pump 13 has standard design impellers. The shaft of motor 16 connects to the seal section shaft (not shown), which in turn is connected to a gas separator 19 that is connected to the charge pump 12. The pump assembly 11 and well fluid 18 are located within a casing 20, which is part of the well 10. Pump 12 connects to tubing 22 that is needed to convey the well fluid 18 to a storage tank (not shown) or pipeline.

The submersible pump assembly 11 depicted in FIG. 1 shows one embodiment of the invention. Other variations include the omission of the gas separator 19 or the use of one centrifugal pump 13 that comprises at least one impeller designed in accordance with the new invention. Other suitable variations will be known to those skilled in the art and are within the scope of the present invention.

FIG. 2 illustrates a conventionally designed impeller 24 taken along the line of 2-2 of FIG. 1. Impeller 24 comprises a plurality of vanes 26, each which discharges fluid at an exit angle 28. Vanes 26 of conventional design have a unibody, one-piece design. Exit angle 28 typically ranges between 15 degrees to 35 degrees. Impeller 24 can have balance holes 30. Balance holes 30 are located between vanes 26 and are typically positioned closer to a back, or concave, side 32 than the pressure, or convex, side 34 of each vane 26.

FIG. 3 illustrates an impeller 40 that has been designed in accordance with the present invention taken along the line of 3—3 of FIG. 1. Impeller 40 comprises a plurality of vanes 42. Vanes 42 comprise two pieces, an inner radial member 44 and an outer radial member 46. The inner radial member 44 and outer radial member 46 have a different radius of curvature, with the inner radial member 44 having a larger radius of curvature than the outer radial member 46. The length of the inner radial member 44 is greater than the length of outer radial member 46. The inner radial member 44 has a larger radius of curvature than the outer radial member 46. Preferably inner radial member 44 curves about the same as an inner portion of vanes 26 of the prior art impeller 24 of FIG. 2. Outer radial member 46 curves more sharply.

The vane configuration of the present invention is called a split-vane configuration. In a split-vane configuration, a concave side 48 of the inner radial member 44 is offset from a convex side 50 of the outer radial member 46, without the concave side 48 of the inner radial member 44 contacting the convex side 50 of the outer radial member 46. The outer end of inner radial member 44 is offset from and thus leads the inner end of outer radial member 46, as shown in FIG. 3. The outer end of inner radial member 44 can also trail the inner end of outer radial member 46 if the impeller is rotated in a different rotation direction. A gap 45 exists between the outer end of inner member 44 and the inner end of outer radial member 46. The split-vanes 42 have an exit angle 51 that typically ranges between about 50 degrees up to about 90 degrees. The exit angle 51 is measured from a line tangent to the circular periphery of impeller 40 to a line extending straight from the outer radial member 46.

Split-vanes 42 also comprise a plurality of flow passages 52 defined on one side by the concave side 48 of the inner radial member 44 and a concave side 54 of the outer radial member 46 and on another side by a convex side 56 of a next inner radial member 44 and the convex side 50 of a next outer radial member 54. A balance hole 58 is located in each flow passage 52. Each balance hole 58 extends upward from each passage 52 through the upper side or shroud 59 of impeller 40. Balance holes 58 have a diameter in a range of about 45% to about 100% of a distance 60 measured from the concave side 48 of the inner radial member 44 to the convex side 56 of the next inner radial member 44. In a preferred embodiment of the present invention, balance holes 58 are substantially tangential on opposite sides to the inner radial members 48, 54 of the vanes 42 defining the flow passage 52 in which each balance hole 58 is located.

With reference to FIG. 4, centrifugal pump 12 has a housing 61 (not shown in FIG. 2) that protects many of the pump 12 components. Pump 12 contains a shaft 62 that extends longitudinally through the pump 12. Diffusers 64 (only one partially shown) have an inner portion with a bore 66 through which shaft 62 extends. Each diffuser 64 contains a plurality of passages 65 that extend through the diffuser 64. An impeller 40 is placed within each diffuser 64. Impeller 40 also includes a bore 68 that extends the length of impeller 40 for rotation relative to diffuser 64 and is engaged with shaft 62. Thrust washers (not shown) are placed between the upper and lower portions between the impeller 40 and diffuser 64.

Impellers 40 rotate with shaft 62, which increases the velocity of the fluid 18 being pumped as the fluid 18 is discharged radially outward through passages 52. The fluid 18 flows inward through diffuser passages 65 and returns to the intake of the next stage impeller 40, which increases the fluid 18 pressure. Increasing the number of stages by adding more impellers 40 and diffusers 64 can increase the pressure of the fluid 18.

The split-vane geometry minimizes the phase separation by reducing the pressure differential between the pressure side, or concave side 48, 54, and the suction side, or convex side 44, 50 of the vane 42 that helps maintaining homogeneity of the two-phase fluid. The gap 45 between inner radial member 44 and outer radial member 46 allows the fluid to flow between the members 44, 46, allowing for greater homogenization between the two phases. The oversized balance hole 58 opens up the passageway connecting the front, or upper, side and the back, or lower, side of the impeller 40 that makes the space in the balance chamber on the back side of the impeller available for additional gas and liquid mixing. The large vane exit angle 51 aligns the secondary flow lines formed inside the impeller in the direction of the main flow. The alignment is due to the changes in flow direction, the curved shape of the vane 42 geometry, and the influence of the pressure gradients between vanes. Inner and outer radial members 44, 46 have different radii of curvature. The different radii aids in the mixing of the materials in the two phases. As a result, the influence of the flow in the boundary layer upon the main flow is a decrease in the flowrate in the boundary layer and possibly a large energy loss, but only under certain circumstances. As an example, as the discharge pressure increases, the gaseous fraction is reduced with the compression of the two-phase fluid.

The pump of the present invention can be used as a charge pump ahead of a conventional centrifugal pump, preferably in a lower tandem configuration. As an alternative, one single centrifugal pump can be utilized that has at least one of the impellers designed in accordance with the present invention and at least one conventional impeller.

In a gaseous application, the pump efficiency is mostly controlled by the phase separation due to the gas velocity being significantly lower than the liquid velocity and the vacant zone inside the impeller. This effect becomes relatively smaller if the gas is well mixed in the liquid. The interphase drag force in the homogenous flow is so large that the pump performance will not dramatically decrease until phase separation occurs. The invention performs well in fluids that contain up to about 50% vol. of free gas.

The invention has significant advantages. The present invention performs well with fluids containing up to 50 vol. % free gas, which is significantly higher than previous attempts of using a centrifugal pump with high gas content fluids. The present invention prevents centrifugal pumps from becoming gas locked due to a high gas content in the well fluid. The new design also improves the performance of the centrifugal pumps by increasing the head, capacity, and efficiency of the pump.

While the invention has been shown or described in only some of its forms, it should be apparent to those skilled in the art that it is not so limited, but is susceptible to various changes without departing from the scope of the invention.

For example, the impeller design of the present invention can be used in other types of applications besides in wells. Other applications will be known to those skilled in the art. Another example is that the impeller can be used for other types of pumping systems besides ESP's. Other applications can include use of the impellers within surface pumps and turbines. Various equipment configurations can also be used, such as placing the gas separator upstream or downstream of the charge pump of the present invention.

I claim:

1. A centrifugal pump comprising:

a plurality of impellers;

a plurality of vanes on the impellers each of the vanes having an inner radial member and an outer radial member, defining a plurality of flow passages;

wherein the inner radial member and the outer radial member have a different radius of curvature; and wherein an outer end of the inner radial member is offset from and leads an inner end of the outer radial member, considering a direction of rotation.

2. The pump of claim 1 wherein the inner radial member has a larger radius of curvature than the outer radial member.

3. The pump of claim 1 wherein the outer radial member of the vanes has an exit angle in the range of about 50 degrees up to about 90 degrees.

4. The pump of claim 1 wherein the outer end of the inner radial member is separated by a gap from the inner end of the outer radial member.

5. The pump of claim 1 further comprising:

a balance hole located in each flow passage and extending through an upper side of the impeller; and wherein each of the balance holes has a diameter in a range of about 45% to about 100% of a distance between the inner radial members of each of the flow passages.

6. The pump of claim 5 wherein each of the balance holes is substantially tangential on opposite sides to the inner radial members of each of the flow passages.

7. A centrifugal pump comprising:

a plurality of impellers;

a plurality of vanes on the impellers, defining a plurality of flow passages;

a balance hole located in each flow passage and extending through an upper side of the impeller; and wherein each of the balance holes has a diameter in a range of about 45% to about 100% of a distance between the vanes of each of the flow passages.

8. The pump of claim 7 wherein each of the balance holes is substantially tangential on opposite sides to one of the vanes.

9. A centrifugal pump comprising:

a plurality of impellers;

a plurality of vanes on the impellers, defining a plurality of flow passages;

a balance hole located in each flow passage and extending through an upper side of the impeller, and wherein each of the balance holes has a diameter in a range of about 45% to about 100% of a distance between the vanes of each of the flow passages and wherein each of the vanes has an inner radial member and an outer radial member wherein the inner radial member and the outer radial member have a different radius of curvature; and wherein an outer end of the inner radial member is offset from and leads an inner end of the outer radial member, considering a direction of rotation, and is spaced therefrom by a gap.

10. The pump of claim 9 wherein each of the balance holes is substantially tangential on opposite sides to the inner radial members of each of the flow passages.

11. The pump of claim 10 wherein the inner radial member has a larger radius of curvature than the outer radial member.

12. The pump of claim 10 wherein the outer radial member of each of the vanes has an exit angle in the range of about 50 degrees up to about 90 degrees.

13. A system for pumping a gaseous fluid comprising:

a centrifugal pump having a plurality of impellers;

a plurality of vanes on the impellers each of the vanes having an inner radial member and an outer radial member, defining a plurality of flow passages;

wherein the inner radial member and the outer radial member have a different radius of curvature;

wherein an outer end of the inner radial member is offset from and leads an inner end of the outer radial member, considering a direction of rotation;

a balance hole located in each flow passage and extending through an upper side of the impeller; and wherein each of the balance holes has a diameter in a range of about 45% to about 100% of a distance between the inner radial members of each of the flow passages.

14. The system of claim 13 wherein the inner radial member has a larger radius of curvature than the outer radial member.

15. The system of claim 13 wherein the outer radial member of each of the vanes has an exit angle in the range of about 50 degrees up to about 90 degrees.

16. The system of claim 13 wherein each of the balance holes is substantially tangential on opposite sides to the inner radial members of each of the flow passages.

17. The system of claim 13 further comprising a gas separator located upstream of the pump.

18. A method of pumping a gaseous fluid in a well, comprising the following steps:

a. providing a centrifugal pump comprising a plurality of impellers with a plurality of vanes on at least one of the impellers defining flow passages, wherein the vanes include an inner radial member and an outer radial member such that the inner radial member and the outer radial member have a different radius of curvature and an outer end of the inner radial member is offset from and leads an inner end, considering a direction of rotation, and is separated by a gap from the outer radial member, b. lowering the pump into the gaseous fluid in the well;

c. introducing the gaseous fluid into the gas-handling centrifugal pump;

d. rotating the impellers, causing the gaseous fluid to flow through and out flow passages, with some of the fluid circulated back through the gaps between the inner and outer radial members prior to discharging from the flow passages.

19. The method of claim 18 wherein step (d) comprises discharging the fluid from the flow passages at an exit angle in the range of about 50 degrees up to about 90 degrees.

20. The method of claim 18 further comprising separating and removing at least some gas from the gaseous fluid prior to introducing the gaseous fluid into the pump.

21. The method of claim 18 further comprising placing at least one additional impeller downstream of the first mentioned impeller, the additional impeller having unibody vanes that extend in a continuous curve from an inner end to an outlet of the additional impeller.

* * * * *